US006094946A

United States Patent [19]

Morita et al.

[11] Patent Number: 6,094,946

[45] Date of Patent: Aug. 1, 2000

[54] NEEDLE BED CLEANER FOR A FLAT KNITTING MACHINE

[75] Inventors: Toshiaki Morita; Kenji Ikoma, both of Wakayama, Japan

[73] Assignee: Shima Seiki Manufacturing, Ltd., Wakayama, Japan

[21] Appl. No.: 09/241,734

[22] Filed: Feb. 2, 1999

[30] Foreign Application Priority Data

Feb. 3, 1998 [JP] Japan ..... 10-21934

[51] Int. Cl.[7] ..... D04B 37/00; D04B 35/32

[52] U.S. Cl. ..... 66/168

[58] Field of Search ..... 66/168

[56] References Cited

U.S. PATENT DOCUMENTS 4,757,698 7/1988 Seitz et al. ..... 66/168

4,765,158 8/1988 Goller et al. ..... 66/168

FOREIGN PATENT DOCUMENTS 36 26 759 2/1988 Germany .

50-134462 11/1975 Japan .

7-229040 8/1995 Japan .

*Primary Examiner*—Andy Falik

*Attorney, Agent, or Firm*—Arent Fox Kintner Plotkin & Kahn, PLLC

[57] ABSTRACT

A flat knitting machine has a blower that is connected to a nozzle via a plastic tube, a base duct and a joint. The base duct is mounted on a rear cover of the flat knitting machine parallel to a needle bed and is rectangular in section. A long slit covered by a belt is provided on top of the base duct. The joint has three rollers, two of which make the belt contact the slit. The third roller peels the belt from the slit to connect the nozzle and the base duct. When the nozzle is connected to the carriage and travels over the needle beds, the needle beds are cleaned.

4 Claims, 9 Drawing Sheets

NEEDLE BED CLEANER FOR A FLAT KNITTING MACHINE

FIELD OF THE INVENTION

The present invention relates to a needle bed cleaner for a flat knitting machine having at least a front needle bed and a back needle bed.

PRIOR ART

Various needle bed cleaners have been proposed. Nozzles of these needle bed cleaners reciprocate in the longitudinal direction of needle beds of a flat knitting machine. They clean and remove fiber waste of yarn, dust, etc. sticking around the trick gap between the front needle bed and the back needle bed. Cleaning and removal of dust, etc. is effected by suction of air, and this system does not scatter dust. A nozzle of a cleaner travelling over the needle beds and a blower fixed on a flat knitting machine are connected with a flexible tube of plastics. So, irrespective of the position of the nozzle over the needle beds, the plastic tube is deformed according to the position of the nozzle, and suction is effected at a suction port in the top end of the nozzle. The plastic tube, however, lacks positional stability as it is deformed momentarily with travelling of the nozzle. So the piping needs a guiding mechanism for the tube and poses a problem of sufficient piping space. Japanese Unexamined Utility Model No. 50-134462 discloses a needle bed cleaner. It comprises a suction duct having a long open hole extending from one end of the duct to the other end, a movable strip covering the open hole, and a suction tube fixed onto the strip. In this cleaner, the movable strip moves on the hole, and therefore, the suction tube associated with the suction duct also moves on the hole. However, according to this cleaner, the whole strip and the suction tube are required to reciprocate on the open hole, and the friction onto the strip resultant from the suction power through the open hole is large.

SUMMARY OF THE INVENTION

One object of the present invention is to install, in a knitting machine in a space saving and compact way, a pipe of a needle bed cleaner that forms a vent channel connecting a blower and a nozzle travelling over needle beds.

Another object of the present invention is to halt the nozzle at a side end of the knitting machine while knitting is effected by a carriage, make the nozzle travel over the needle beds only when cleaning is required and use an existing driving power for the carriage for the shift of this nozzle.

Another object of the present invention is to provide a needle bed cleaner having a shifter that makes the nozzle stand by in a retracted position where the nozzle does not interfere with any yarn feeder.

EMBODIMENT

Figure 1:
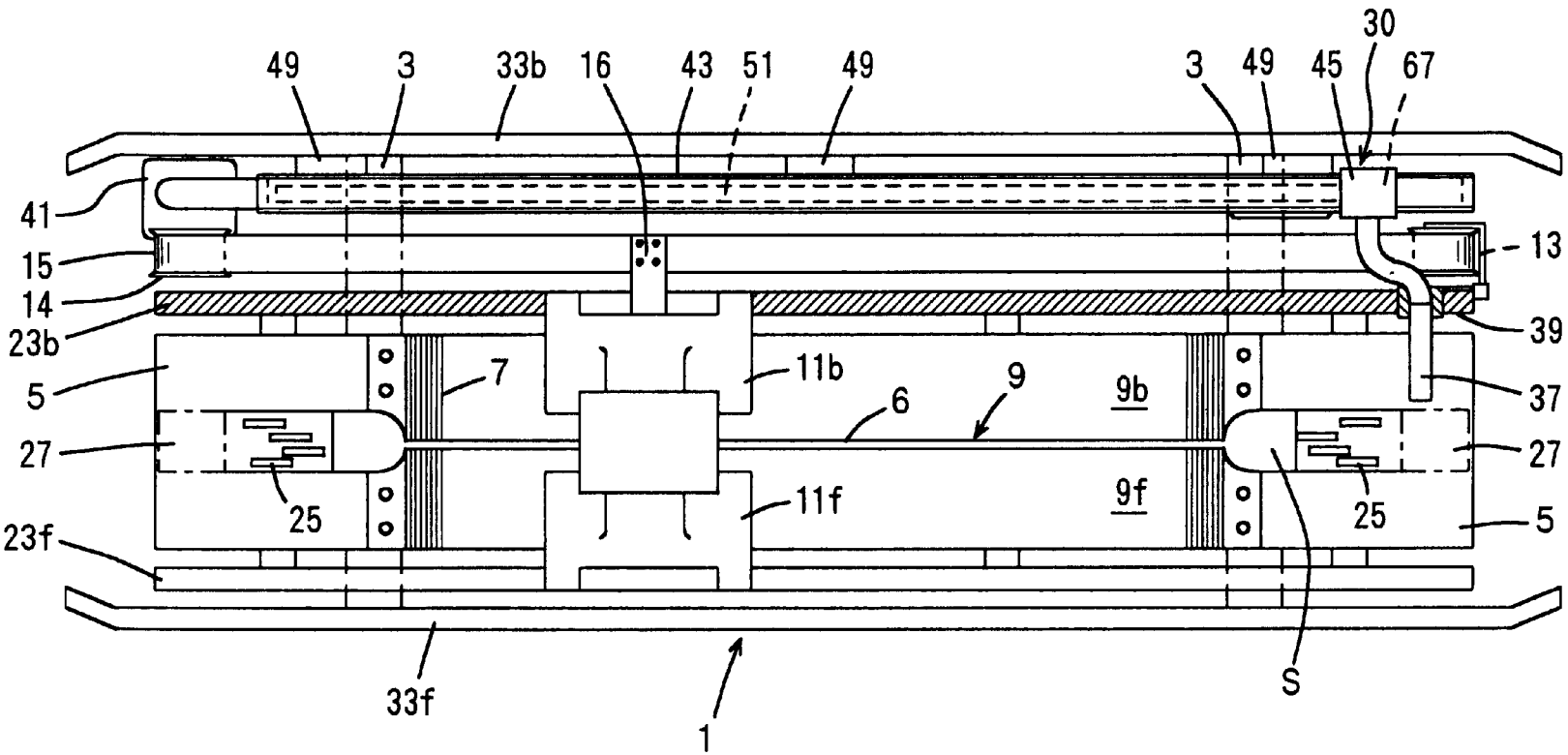
FIG. 1 is a plan view of a flat knitting machine having a needle bed cleaner of an embodiment of the present invention with parts broken away for clarity.
Figure 2:
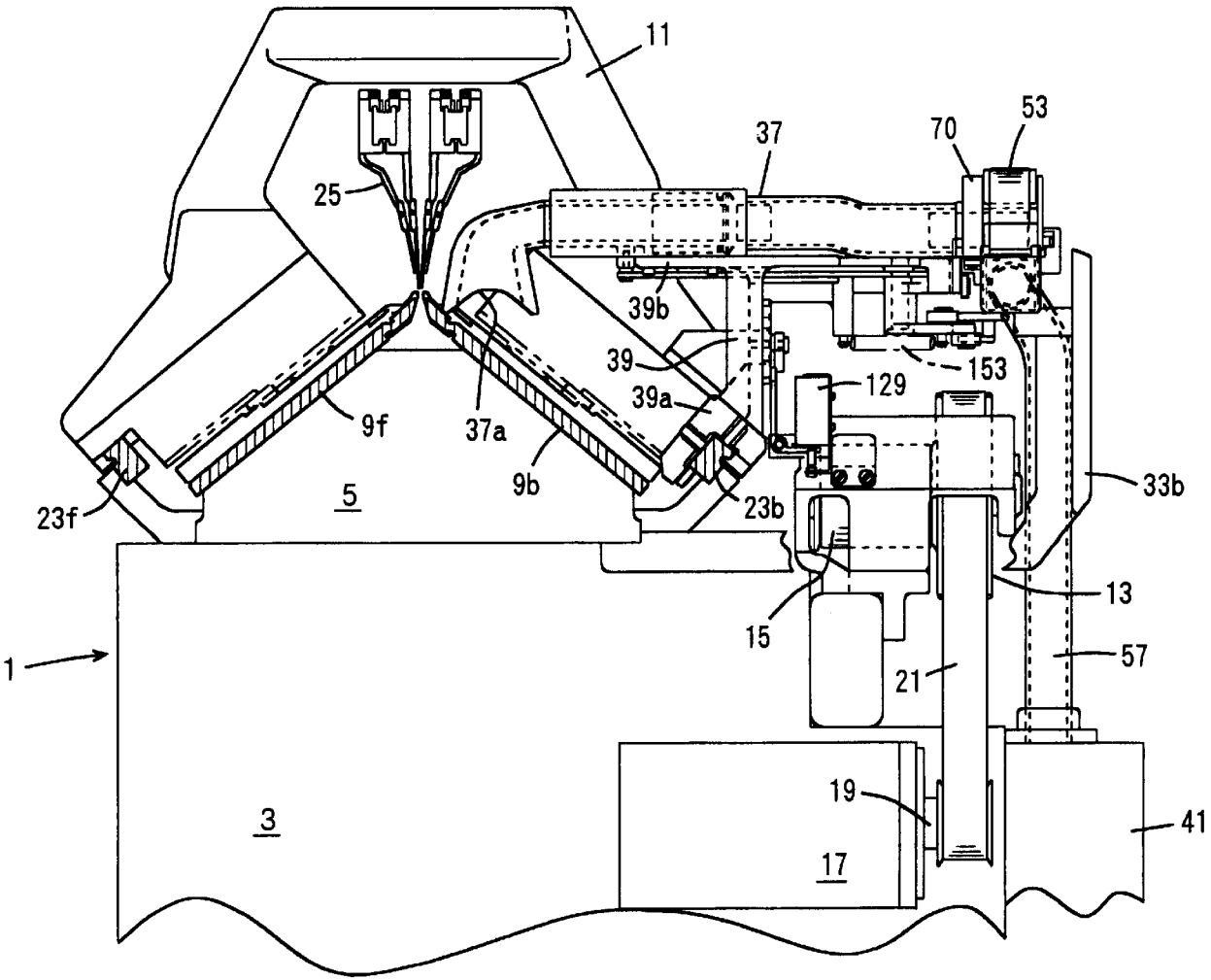
FIG. 2 is a fragmentary side view of the flat knitting machine having the needle bed cleaner of the embodiment.
Figure 3:
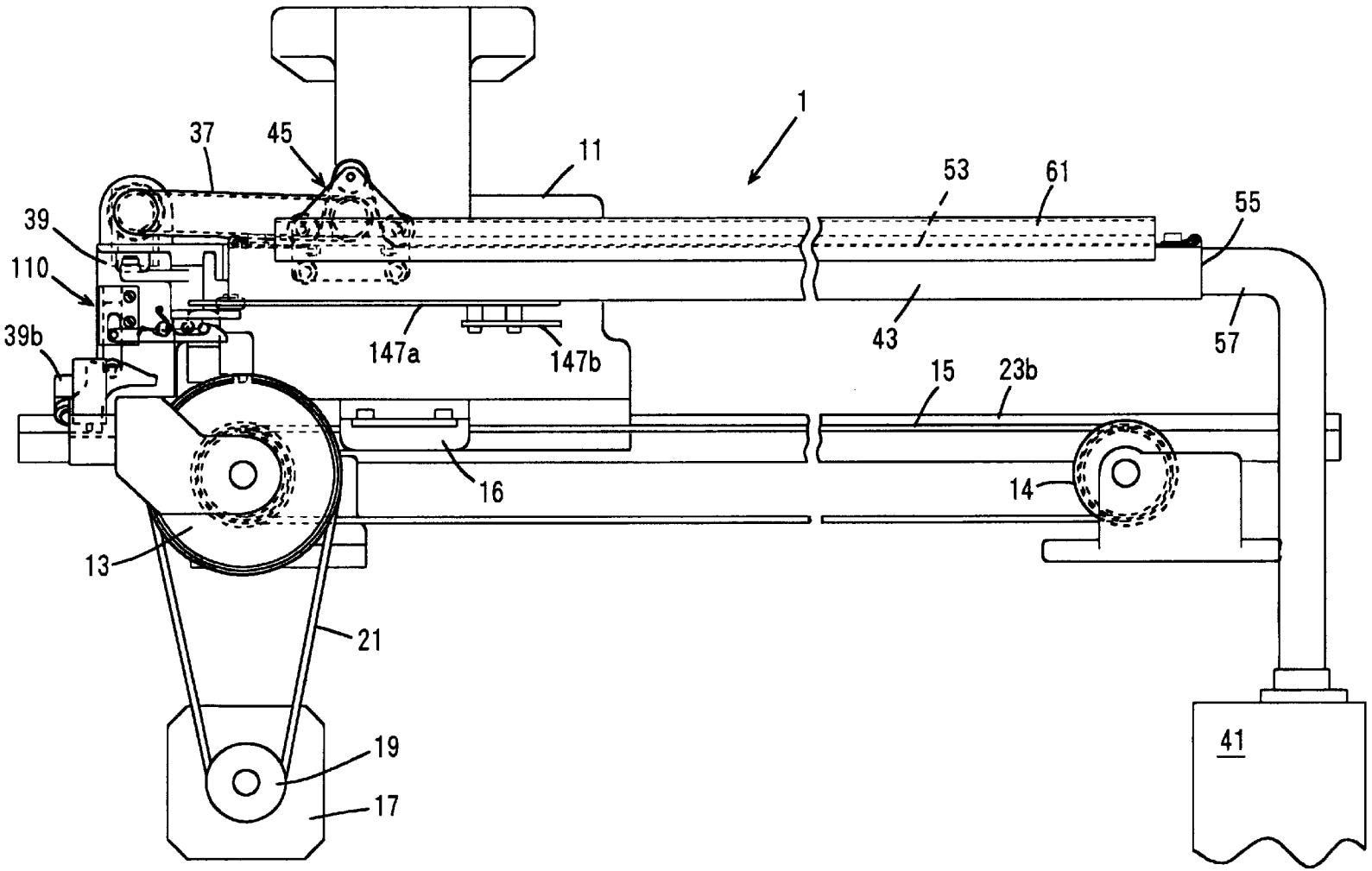
FIG. 3 is a fragmentary rear view showing the needle bed cleaner of the embodiment and the carriage of the flat knitting machine.
Figure 4:
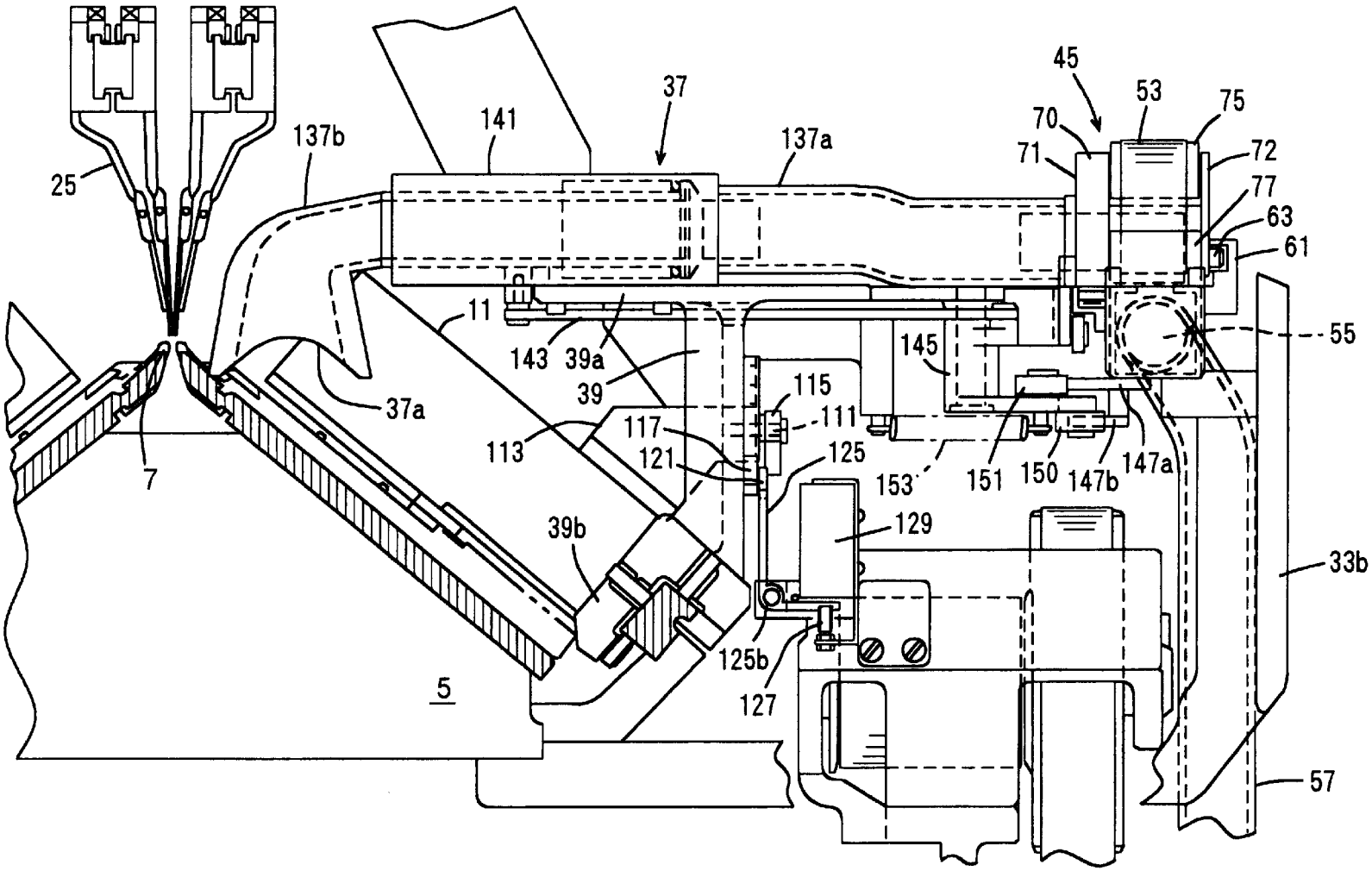
FIG. 4 is an enlarged view of a part of FIG. 2, showing the nozzle of the needle bed cleaner standing by at one side end of the flat knitting machine.
Figure 5:
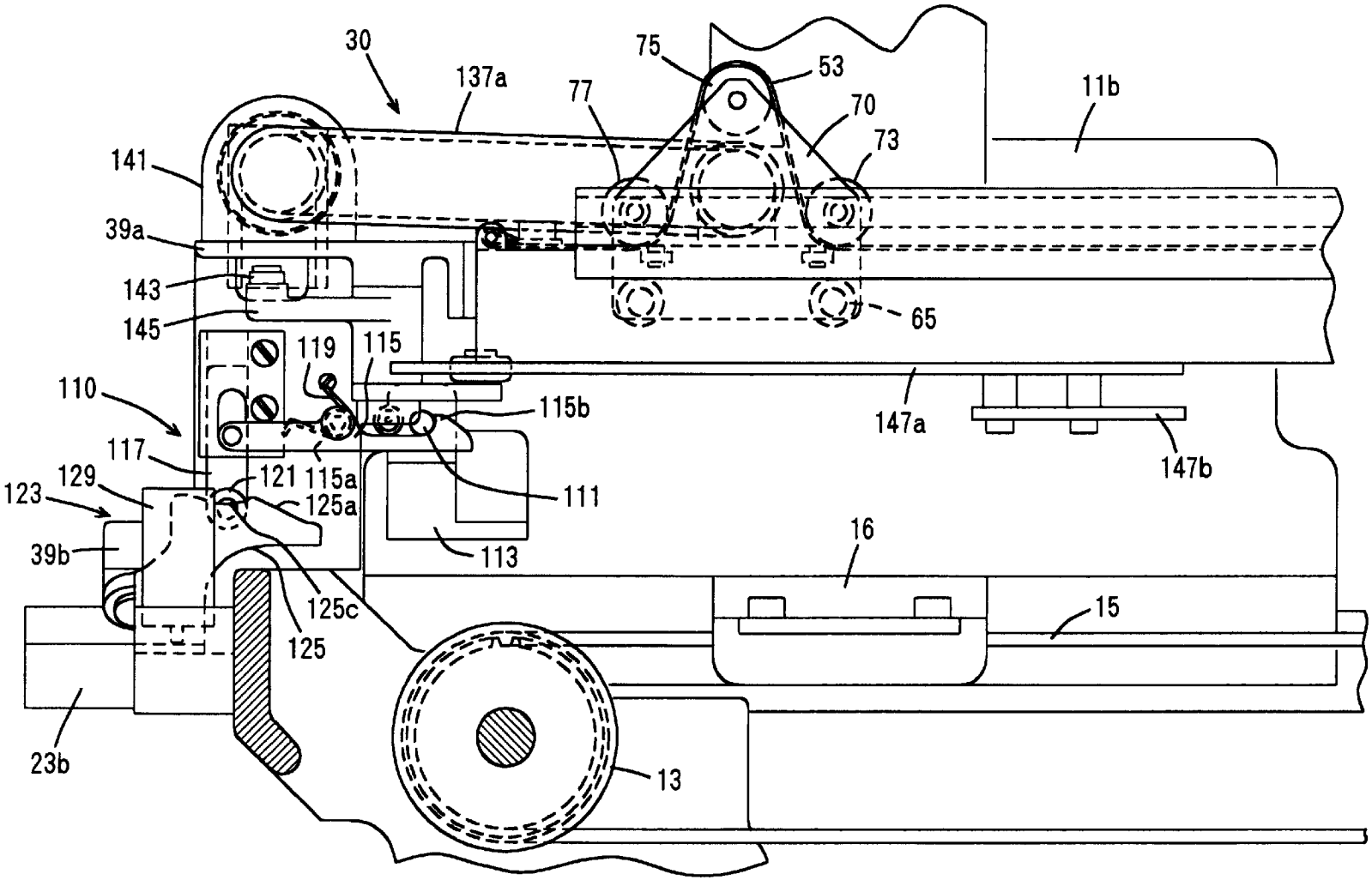
FIG. 5 is an enlarged view of a part of FIG. 3, showing the nozzle that is connected with the carriage at a side end of the flat knitting machine by connecting means.

A preferred embodiment of the needle bed cleaner of the present invention for a flat knitting machine will be described with reference to drawings. FIG. 1 is a plan view showing the flat knitting machine. FIG. 2 is a side view of the flat knitting machine. FIG. 3 is a rear view. It should be noted that to clearly show the arrangement of the needle bed cleaner, tension equipment, cone stands, carrier rails, carrier rail brackets, etc. are omitted in FIG. 1. Similarly, needle beds, frames and yarn feeders are omitted in FIG. 3. FIG. 4 is an enlarged view of a part of FIG. 2. FIG. 5 is an enlarged view of a part of FIG. 3.

A bed 5 is supported on a right frame 3 and a left frame 3 of a flat knitting machine 1. Needle beds 9*b*, 9*f* on which a large number of knitting needles 7 are aligned are arranged on the bed 5, the former in the back and the latter in the front, with a trick gap in between them. A carriage 11 comprises back and front carriages 11*b*, 11*f*. The carriage 11 is connected and fixed onto a driving belt 15 by a connecting part 16. The driving belt 15 is stretched between pulleys 13, 14 that are provided on the left and on the right, respectively. The pulley 13 is a reducing pulley and, as shown in FIG. 2, it is connected, by a driving belt 21, to a driving pulley 19 of a driving motor 17 that is fixed on the frame 3. The pulley 13 converts rotation of the driving motor 17 into reciprocative motion of the driving belt 15 to make the carriage 11 reciprocate along the needle beds 9. The yarn feeders 25 feed yarn to knitting needles 7 on the needle beds 9, and the carriage 11 moves knitting needles 7 forward and backward to knit a knitted fabric. 23*f* and 23*b* denote guide rails for carriage that guide the carriage 11 above the needle beds. 25 denotes yarn feeders held on yarn rails. Initially, the yarn feeders 25 stand still on both the outer sides of the needle beds 9. Normally two to four yarn rails are provided in a flat knitting machine. These yarn rails are suspended by yarn rail supporting brackets (not illustrated) at both ends thereof. A mounting position 27 of a yarn rail supporting bracket onto the bed 5 is indicated by a dashed line. 30 denotes a needle bed cleaner. In FIG. 1, the needle bed cleaner 30 is on standby at one side end of the knitting machine. 33*f* denotes a front cover of the flat knitting machine and 33*b* denotes a rear cover thereof.

The needle bed cleaner 30 includes a nozzle 37 that travels along the needle beds 9 and has a suction port, a nozzle support 39 for supporting the nozzle 37, a base duct 43 that connects the nozzle 37 and a blower 41 having a blower motor, and a joint 45 for connecting the nozzle 37 and the base duct 43. The cleaner also includes nozzle travelling means for moving the nozzle 37 along the needle beds 9. In the embodiment, the nozzle support 39 shown in FIG. 2 is approximately T-shaped when seen from the side, and its lower end 39*a* is slidably supported via rollers on the rear guide rail for carriage 23*b*. A top end part 39*b* of the T supports the nozzle 37.

Between the nozzle 37 and the blower 41, as shown in FIG. 3, there are the joint 45 and the base duct 43. The base duct 43 is longer than the needle beds 9 and is a metal rectangular tube with a rectangular section. The base duct 43 is fixed to a rear cover 33*b* by support brackets 49. The rear cover 33*b* covers the rear of the flat knitting machine. A slit 51 shown in FIG. 1 is formed in the base duct 43 along one face thereof, for example on the top face. In place of the slit, a large number of through holes may be formed. In the embodiment, as shown in FIG. 1, the slit 51 is formed over the full length of the base duct in the center of the top face of the base duct 43. As shown in FIG. 3, over the slit, a belt 53 of, for example, nylon that is wider than the width of the slit, non air-permeable and flexible is stretched to cover the slit. Both ends of the belt 53 are fixed onto the base duct.

Figure 6:
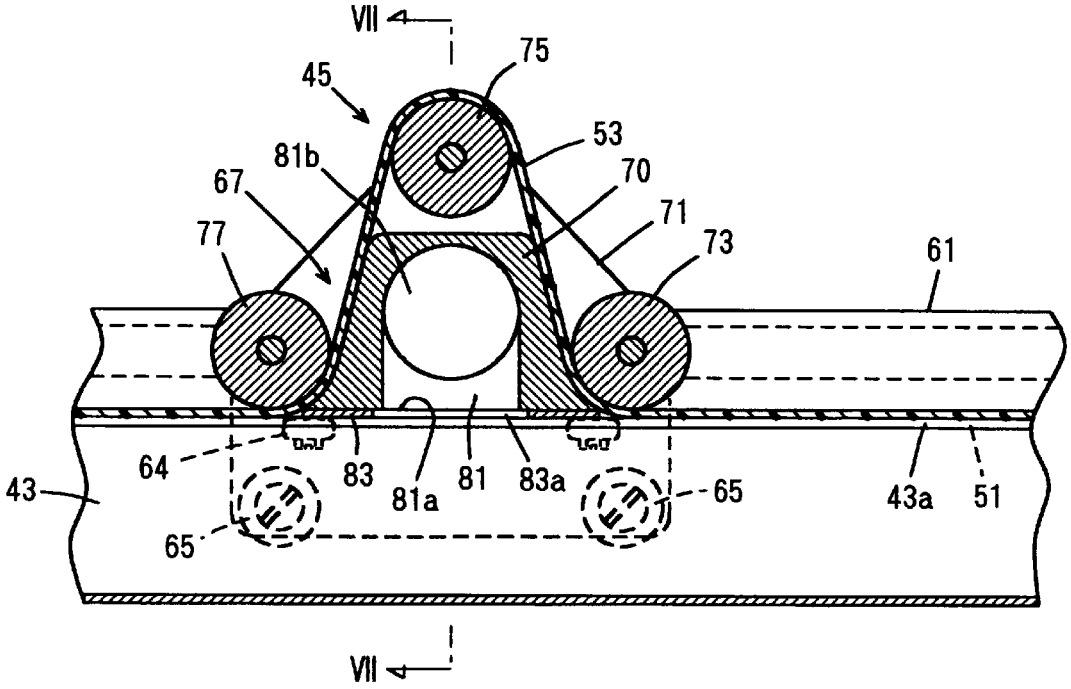
FIG. 6 is a sectional view of a joint of the needle bed cleaner. The section is parallel to the longitudinal direction of the needle beds.

As shown in FIG. 6, due to a negative pressure in the base duct 43, the belt 53 is suctioned to a supporting face 43*a*, in which the slit 51 is formed, of the base duct 43. As a result, the belt 53 prevents the loss of the negative pressure through the slit 51 and in turn a rise in air pressure in the base duct 43.

At one end of the base duct 43, an opening 55 shown in FIG. 3, etc. is formed, and the blower 41 fixed on the frame 3 and the opening 55 are connected with a flexible plastic tube 57. Instead of this arrangement, a part of the base duct 43, for example a central part thereof may be extended downward and directly connected with the blower 41. Then, the plastic tube 57 is not needed.

Figure 7:
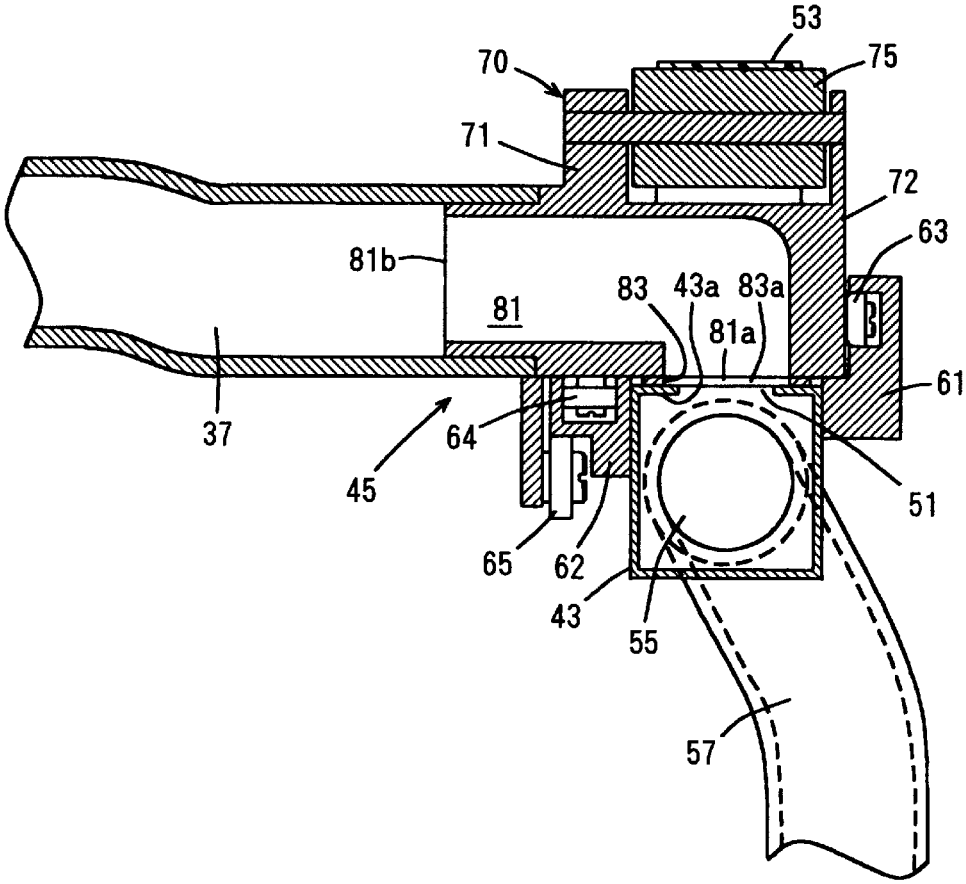
FIG. 7 is a sectional view of the joint of the needle bed cleaner along the line VII—VII of FIG. 6.

Next, the joint 45 that is provided at the connecting part between the nozzle and the base duct 43 will be described. FIG. 6 shows a transverse section of the joint 45 or the section that is parallel to the longitudinal direction of the needle beds. FIG. 7 shows a longitudinal section thereof or the section that is perpendicular to the needle beds.

A joint base 70 of the joint 45 is supported on the base duct 43 in such a way that it can travel freely in the longitudinal direction of the duct. Rollers 63, 64, 65 that are installed on the joint base 70 are rotatably inserted into guiding grooves of guide rails 61, 62 that are mounted on the base duct 43. The joint 45 is provided with a belt support means 67. When the nozzle 37 travels along the needle beds 9, the belt 53 in the belt support means 67 is peeled portion after portion from the belt supporting face 43*a* of the base duct against the suction force due to the negative pressure. As a result, via the slit of the peeled portion, an air vent channel connecting the base duct 43 and the nozzle 37 is formed.

When seen from the front, the joint base 70 is triangular. Between a base front 71 and a base rear 72, three rollers 73, 75, 77 of which rotating axes are in the same direction as those of the pulleys 13, 14 are rotatably supported by bearings that are provided near the respective corners of the triangle. As shown in FIG. 6, the belt 53 is threaded through the rollers 73, 75, 77. The base rollers 73, 77 that are located in lower positions prevents the belt that covers the slit 51 from lifting from the supporting face 43*a*. The top roller 75 that is located at the vertex of the triangle peels the belt 53 between the base rollers 73, 75 from the slit 51. The joint base 70 and rollers 73, 75, 77 constitute the belt support means 67.

Inside the joint base 70, an L-shaped vent channel 81 is integrally formed. One opening 81*a* of the vent channel 81 is connected to the slit 51 of the base duct 43. The other opening 81*b* thereof is formed in a front protruding portion of the base front 71 and this opening 81*b* is connected to the back end 37*b* of the nozzle 37. 83 denotes a packing that is rectangular and has an insertion hole 83*a* at the center thereof. The opening 81*a* of the vent channel is connected to the insertion hole 83*a*, and the packing 83 prevents loss of the negative pressure.

In the needle bed cleaner 30, as described above, a suction channel is formed between the blower 41 and the nozzle 37. As a result, irrespective of the travelling of the nozzle 37 to any position along the needle beds 9, a negative pressure generated by the blower 41 works on the suction port 37*a* at the top end of the nozzle and fiber waste and dust on the needle beds 9 are suctioned and removed. As the base duct is fixed to the knitting machine, the space for storing it in the knitting machine is reduced.

The motor 17 for reciprocating the carriage is also used as the nozzle travelling means to reciprocate the nozzle 37 along the needle beds 9. Accordingly, there is no need of separately providing a driving motor for the needle bed cleaner 30.

Next, connecting means 110 for the nozzle 38 and the carriage 11 will be described. As shown in FIG. 4 and FIG. 5, the rear carriage 11*b* is provided with a connecting part that engages with a claw 115*b* of a rocking lever that is provided on the nozzle support 39. This connecting part is composed of a connecting pin 111 and a pin mount 113. The rocking lever 115 is supported on the nozzle support 39 by a shaft at the central part 115*a* thereof. The claw 115*b* for engaging with the connecting pin 111 is formed at one end of the rocking lever 115, and the other end thereof is connected with a link 117 that is provided on the nozzle support 39. The rocking lever 115 is supported at a central part 115*a* thereof, and the top end of the rocking lever 115 is constantly energized upward by a helix coil that is fixed to the central part 115*a*, and the claw 115*b* engages with the connecting pin 111.

A roller 121 is supported on a shaft at the lower end of the link 117, and this roller engages with a cam surface 125*a* of a control lever 125. This control lever 125 is a part of a control 123 that is provided at the nozzle standby position at one side end of the flat knitting machine proper. The control lever 125 is L-shaped when seen from its side. The control lever 125 is supported on a shaft at a bending part 125*b* of the L-shaped body in such a way that the cam face 125*a* formed on the upper edge of the lever swings to and fro. Moreover, the control lever 125 is energized by a spring 127 that is provided beneath the lower end of the L-shaped body in such a way that the cam face 125*a* engages with the roller 121. A solenoid 129 is provided above the lower end of the control lever 125 to swing the control lever 125.

Figure 8:
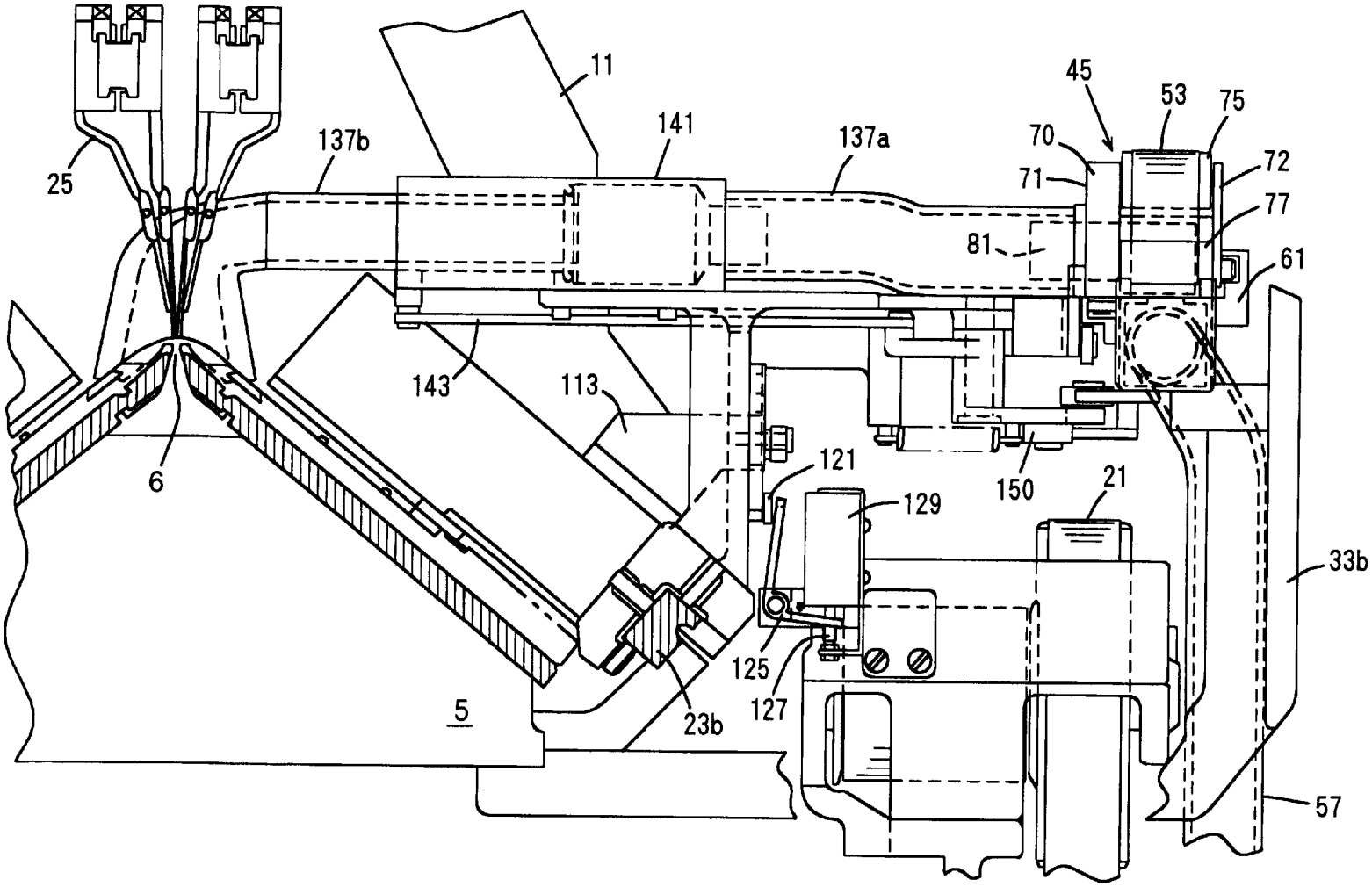
FIG. 8 is a fragmentary enlarged side view showing the needle bed cleaner that is cleaning.

FIG. 5 and FIG. 8 show a state that the nozzle 37 is connected with the carriage 11. When the solenoid 129 is actuated, the cam face 125*a* of the control lever swings backward. Thus, as shown in FIG. 8, the engagement between the roller 121 and the control lever 125 is removed, and because of the energizing force of the helix coil 119, the link 117 slides downward. As a result, the claw 115*a* of the rocking lever will swing upward to catch the connecting pin 111 provided on the carriage 11 and connect the nozzle 37 and the carriage 11. When the carriage 11 travels under this condition, the nozzle 37 will travel as well. During this travelling, the blower is operated to clean the needle beds by the cleaner. After cleaning, the carriage travels back to the one side of the knitting machine. The solenoid 129 is not in operation, and the control lever 125 has been swung by the spring 127 and the cam face 125*a* is in a position where it engages with the roller 121. When the carriage 11 comes closer to the side end, the roller 121 will come to contact with the cam face 125*a* of the control lever. The roller 121 is pushed upward gradually by the slope of the cam face 125*a*. As a result, the link 117 slides upward and the top end of the rocking lever 115 swings downward, and the claw 115*a* is disconnected from the connecting pin 111. Under this condition, when the carriage 11 is reversed to travel, the connection between the carriage 11 and the nozzle support 39 will be undone, and the nozzle support 39 will stay at the side end of the knitting machine. During this stay, the roller 121 fits into a concave part 125*c* that is provided in the cam face 125*a* of the control lever to prevent inadvertent motion of the nozzle support 39 (FIG. 5).

Figure 9:
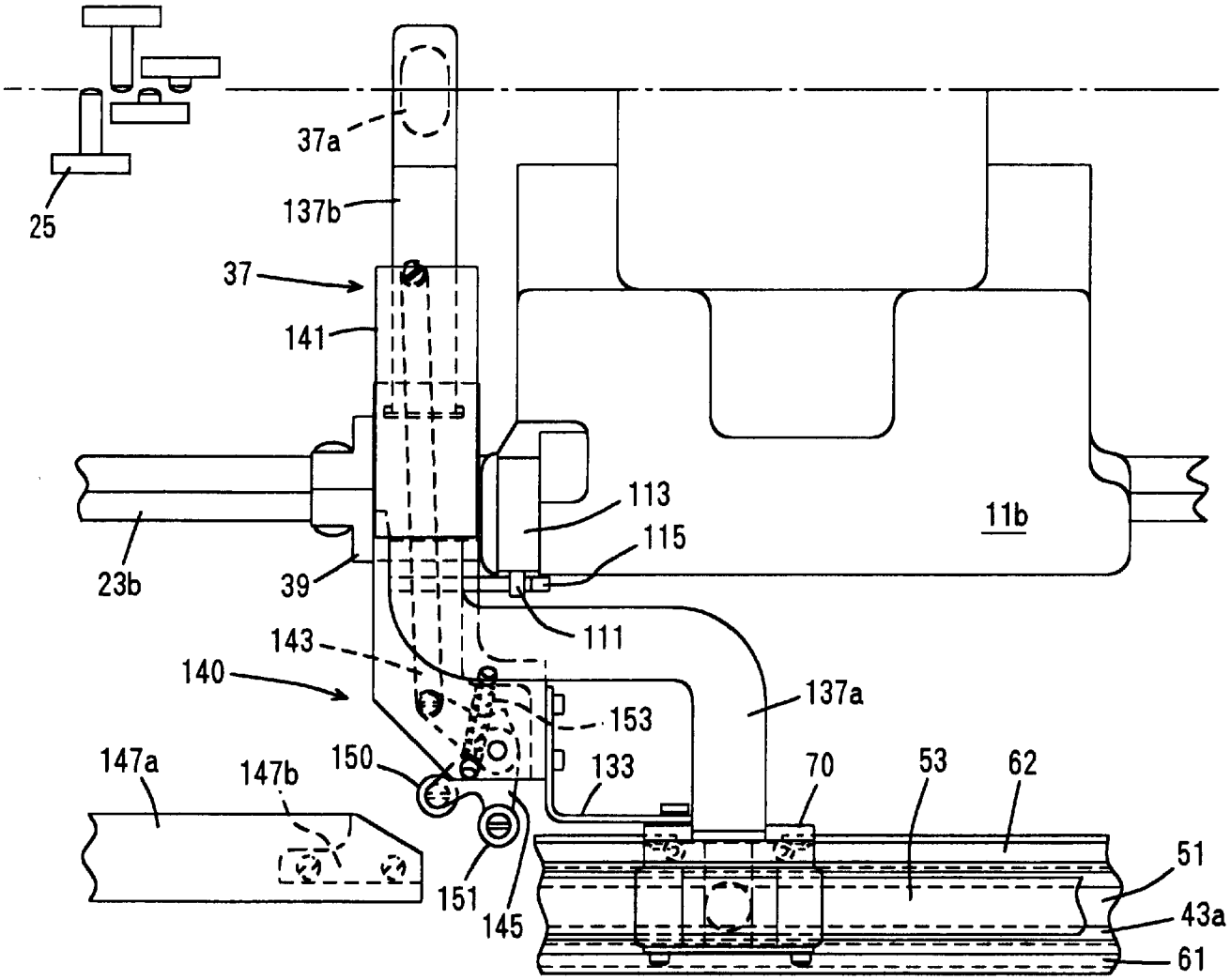
FIG. 9 shows the nozzle and the nozzle shifter provided in the needle bed cleaner. The suction port of the nozzle is extended to the cleaning position.
Figure 10:
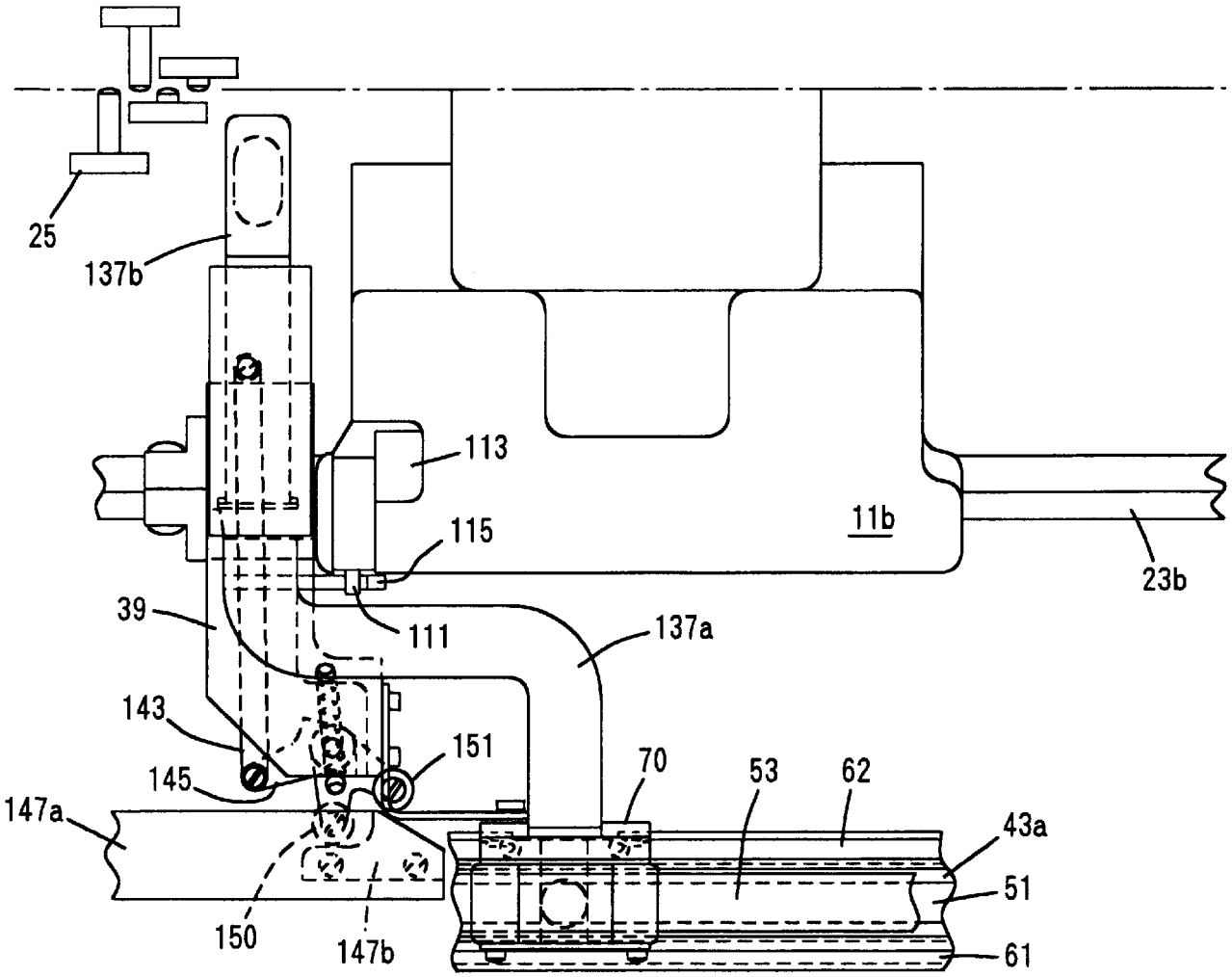
FIG. 10 shows the nozzle and the nozzle shifter provided in the needle bed cleaner. The suction port of the nozzle is retracted to the retreated position.

Next, a nozzle shifter 140 that is provided in the needle bed cleaner 30 will be described. FIG. 9 shows the nozzle that is advanced to a cleaning position. FIG. 10 shows the nozzle that is retracted into a retreated position. The nozzle 37 in the embodiment is composed of a joint 141, a fixed nozzle 137*a* and a movable nozzle 137*b*. The top end of the fixed nozzle 137*a* is connected to the joint 141 that is mounted on the nozzle support 39, and the back end thereof extends to the joint 45. The movable nozzle 137*b* has the suction port 37*a* and is mounted on the joint 141 in such a way that the movable nozzle 137*b* comes close to or moves away from the trick gap. The top end of a link 143 extending in the front-rear direction is connected to the movable nozzle 137*b*, and the back end of the link 143 is connected to a lever 145 that is supported on a shaft on the nozzle support 39. On the lever 145, rollers 150, 151 are supported on shafts at the front side of the top end of one of two-pronged portions thereof and at the back side of the top end of the other prong, respectively. They engage with cams 147*a*, 147*b* that are mounted in two rows, upper one and lower one, on the base duct 43. 153 in FIG. 9 denotes a spring that is arranged between the nozzle support 39 and the lever 145. The spring 153 holds the lever position when the lever is turned, thus preventing inadvertent motion of the lever 145. 133 denotes a connecting piece that fixes the nozzle 37 and the joint base 70 of the joint 45 to each other.

To clean the needle beds with the needle bed cleaner 30, after the nozzle 37 and the carriage 11 are connected together at one side end of the knitting machine, as shown in FIG. 10, the carriage 11 is made to travel up to a position adjacent to an area S between the yarn feeders standing in the initial position and one side end of the needle beds 9 (see FIG. 1). During this time, the roller 151 of the lever 145 rolls over the cam face of the upper cam 147*a* and the link 143 moves backward; thus the nozzle suction port 37*a* assumes its retreated position. Under this condition, when the carriage 11 travels further towards the center of the knitting machine, the roller 150 that is mounted on the bottom of the lever 145 will engage with the cam face of the lower cam 147*b* and the roller 150 will be pushed forward. As a result, the link 143 moves forward, and the nozzle suction port 37*a* advances to the cleaning position above the trick gap 6. Under this condition, the nozzle travels over the needle beds 9 to clean. After completion of cleaning, the carriage 11 is made to travel to the side end of the knitting machine. When the nozzle 37 reaches the area S, the roller that is mounted on the top of the lever 145 will engage with the cam face of the upper cam 147*a* and the nozzle 10 will come back to the state of FIG. 10.

As described so far, the nozzle shifter 140 prevents interference between the top end of the nozzle and the yarn feeders. Moreover, at the side end of the knitting machine, interference with the bracket for supporting yarn rails is prevented, and increase in the width of the knitting machine is prevented. In the above-mentioned nozzle shifter, the nozzle suction port is shifted forward and backward by the linkage between the cleaning position and the retreated position. However, if a linkage that shifts the nozzle upward and downward concurrently with its forward and backward shift is used, the nozzle suction port can go over the top ends of the inverted-V-shaped front and back needle beds when seen from the side. Thus the nozzle can be advanced or retreated not only in the area S but also at any position over the needle beds.

In the present embodiment, the nozzle of the needle bed cleaner is supported by a nozzle support that is slidable on the carriage rails, and the nozzle is connected with or disconnected from the carriage by the connecting means that is provided on the nozzle support. However, instead of this arrangement, if a nozzle standing part like a perch is provided on one side end of the knitting machine, and if connecting means that releases the nozzle from the standing part and connects the nozzle to the carriage just when cleaning is needed is provided, the nozzle support can be omitted. A separate driving motor may be provided as nozzle travelling means, and in this case, no means for connecting with the carriage is required.

What is claimed is:

1. A needle bed cleaner for cleaning the needle beds of a flat knitting machine having at least a front needle bed and a back needle bed, comprising a nozzle for cleaning the needle beds and a blower, said needle bed cleaner characterized in that it further comprises:

a base duct arranged in parallel to one of the needle beds, connected to said blower, and having at least an opening arranged parallel to said one of the needle beds;

a non-air-permeable belt having fixed both ends, arranged in parallel to said base duct, an covering said opening due to suction caused by said blower; and;

a joint connecting said base duct and said nozzle and movable along said base duct and said belt, comprising:

a base held between said belt and said base duct and having a top position; and a top roller located near the top position of the base, the top roller peeling said belt from said opening.

2. A needle bed cleaner for a flat knitting machine of claim 1 characterized in that said joint has a pair of base rollers on both sides of said top roller for making said belt contact said opening at both side ends provided to said base.

3. A needle bed cleaner for a flat knitting machine of claim 2 characterized in that said needle bed cleaner further comprises connecting means for connecting and releasing said nozzle to and from said carriage, wherein said connecting means is adapted to be provided at a side end of the flat knitting machine.

4. A needle bed cleaner for a flat knitting machine of claim 2 characterized in that said nozzle has a suction port and said needle bed cleaner is further provided with a nozzle shifter for shifting said suction port between a cleaning position and which said suction port is adapted to extend close to a trick gap formed between said needle beds and a retreated position at which said suction port is adapted to be moved away from the trick gap.

* * * * *